US005452191A

United States Patent [19]

Lopez

[11] Patent Number: 5,452,191

[45] Date of Patent: Sep. 19, 1995

[54] METHOD OF MAKING A MIRROR FOR A VEHICLE SIGNALLING OR LIGHTING DEVICE, AND A HEADLIGHT FITTED WITH A NOVEL MIRROR

[75] Inventor: Francois Lopez, Bondy, France

[73] Assignee: Valeo Vision, Bobigny, France

[21] Appl. No.: 97,447

[22] Filed: Jul. 26, 1993

[30] Foreign Application Priority Data

Jul. 27, 1992 [FR] France ..... 92 09237

[51] Int. Cl.[6] ..... F21V 7/00

[52] U.S. Cl. ..... 362/297; 362/61; 362/346

[58] Field of Search ..... 362/61, 297, 304, 341, 362/346

[56] References Cited

U.S. PATENT DOCUMENTS 4,481,563 11/1984 Snyder et al. ..... 362/296

4,495,552 1/1985 Graff ..... 362/347 X

FOREIGN PATENT DOCUMENTS 0313216 4/1989 European Pat. Off. .

*Primary Examiner*—Stephen F. Husar

[57] ABSTRACT

In a method of manufacturing a flux-recovering mirror for a motor vehicle signaling or lighting device a base reflecting surface is provided. Mutually spaced apart base points are distributed in at least one zone of the surface. A randomly determined correcting offset is attributed to each base point so that each base point is associated with a corrected point situated on the normal to the base surface at said base point and located at a random distance from said base point. A corrected smooth surface passing through the corrected points is thus defined in the zone to form a mirror whose reflecting surface in said zone is constituted by said correcting smooth surface. The invention also relates to a headlight fitted with a mirror having properties of distributing images randomly. The invention is also applicable to making light beams more uniform.

11 Claims, 4 Drawing Sheets

FIG. 3
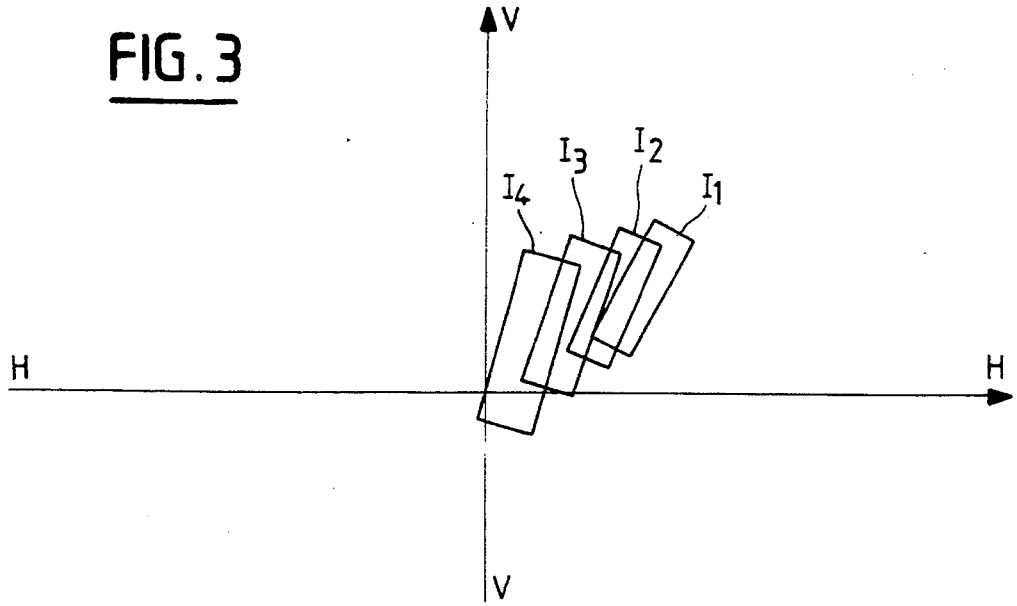
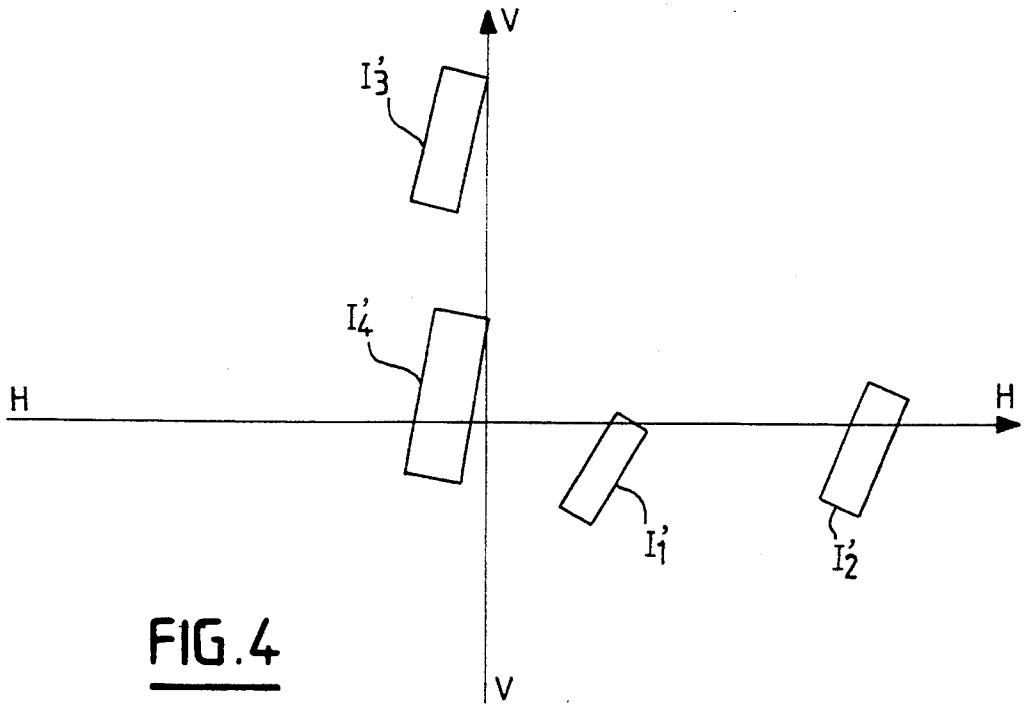
FIG. 4

METHOD OF MAKING A MIRROR FOR A VEHICLE SIGNALLING OR LIGHTING DEVICE, AND A HEADLIGHT FITTED WITH A NOVEL MIRROR

The present invention relates to signalling or lighting devices for motor vehicles.

BACKGROUND OF THE INVENTION

In numerous signalling or lighting devices, and in particular in signalling lights, it is desirable to obtain a beam in which variations in light intensity from one point to another are as regular as possible.

In lighting devices that include a light-recovering mirror, it can be difficult to obtain such uniformity since it is observed, in particular, that certain points of the mirror can produce images of the light source that are extremely close to one another, thus giving rise to spots of concentrated light that are too marked.

A widely-known solution to that problem consists in providing prisms, beads, or stripes on the glass, globe, or front of the signalling or lighting device for the purpose of deflecting the light and in particular for dispersing excessively concentrated light, and correspondingly adding light in zones that are too dim.

Nevertheless, that solution is incompatible with the present trend of making such glasses, globes, or fronts as smooth as possible, in particular for reasons of appearance.

In this context, another solution that springs to the mind of the person skilled in the art consists in providing stripes, prisms, individual blocks, etc. on the mirror itself, so as to retain the predetermined beam outline while nevertheless ensuring greater uniformity of light within said outline.

Unfortunately, that solution complicates manufacture of the mirror and it also turns out to be unattractive in appearance since such light deflecting elements provided on the mirror when seen through the glass give the mirror an irregular appearance when the light is out.

OBJECTS AND SUMMARY OF THE INVENTION

The present invention seeks to mitigate the above drawbacks of the prior art. It is based on the idea that consists in starting with a known reflecting surface as determined by one or more mathematical equations, for example, and in modifying said surface randomly, preferably at a pitch and a standard deviation that are well determined.

Thus, in a first aspect, the invention provides a method of manufacturing a flux-recovering mirror for a motor vehicle signalling or lighting device, the method comprising the following steps:

- defining a base reflecting surface;
- distributing mutually spaced apart base points in at least one zone of said surface;
- attributing a randomly determined correcting offset to each base point so that each base point is associated with a corrected point situated on the normal to the base surface at said base point and located at a random distance from said base point;
- defining in said zone, a corrected smooth surface passing through the corrected points; and
- making a mirror whose reflecting surface in said zone is constituted by said corrected smooth surface.

In the above definition, the term "random" also covers "pseudo-random".

In a second aspect, the invention provides a motor vehicle signalling or lighting device of the type comprising a light source, a mirror including a reflecting surface, and a globe, front, or glass, the reflecting surface being designed to generate a uniform beam, wherein for an arbitrary correlated set of points situated in at least one zone of said reflecting surface, images of the source formed by said points are distributed on a projection screen in a manner such that they are not correlated relative to one another.

BRIEF DESCRIPTION OF THE DRAWINGS

Other aspects, objects, and advantages of the present invention appear more clearly on reading the following detailed description of a preferred embodiment thereof, given by way of example and made with reference to the accompanying drawings, in which:

FIG. 3 is a view on a projection screen showing the outlines of a certain number of images of the incandescent filament obtained using a prior art mirror;

FIG. 4 is a view analogous to FIG. 3 showing the distribution of images obtained using the present invention;

Figure 1:
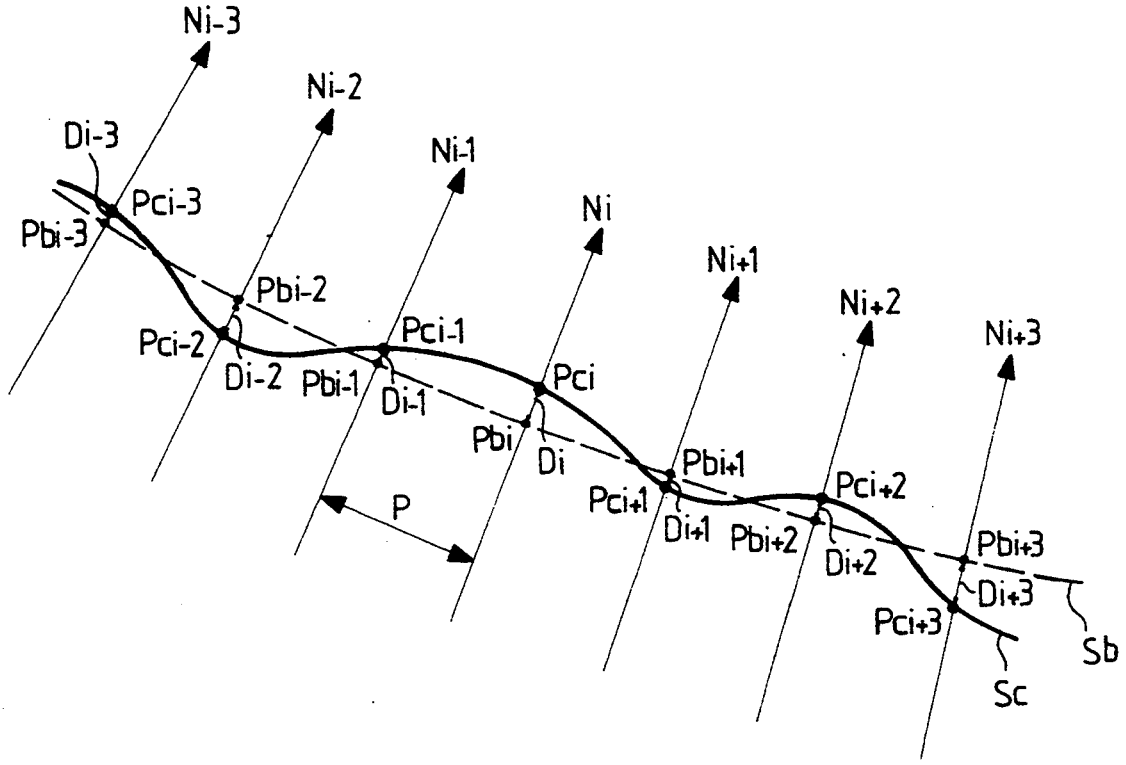
FIG. 1 is a diagrammatic section view through a portion of a reflecting surface made in accordance with the present invention.

As a preliminary point, it should be understood that the offsets perpendicular to the reflecting surface as shown in the drawings are exaggerated for reasons of clarity.

MORE DETAILED DESCRIPTION

FIG. 1 is a section through a portion of a surface Sb conventionally intended to define the reflecting surface of a mirror in a motor vehicle signalling or lighting device.

It is usual for such a surface to be a quadratic, in particular a paraboloid, or else a surface of the kind defined in any one of the French patent applications published under the numbers 2 536 502, 2 536 503, 2 597 575, 2 599 120, 2 599 121, 2 600 024, 2 602 305, 2 602 306, 2 609 146, 2 609 148, 2 622 676, 2 634 004, 2 639 888, and 2 664 677, in the name of the Applicant, for example.

It is recalled that such a surface is designed mainly for the purpose of acting on the position of at least some of the images of the filament produced by said surface so as to obtain a light beam that corresponds to various criteria concerning light distribution (position of a cut-off, position of a concentration spot, thickness of the beam, . . . ).

For implementing the present invention, it is preferable for the surface Sb to be defined either in the form of one or more mathematical equations in coordinates that may be parametric, Cartesian, polar, etc . . . . , or else in the form of a set of coordinates for N points on said surface.

According to the present invention, a plurality of base points marked Pbi-3, Pbi-2, . . . , Pbi+3 are defined on the surface Sb or on one or more determined zones of said surface. These points, all designated by Pbn in the description below for simplification purposes, are preferably regularly distributed in a predetermined pattern, e.g. of squares, rectangles, triangles, etc. . . In the present example, these points correspond to a regular square pattern, at a pitch P that may have a value lying in the range 0.5 mm to 15 mm, for example, and more preferably in the range 2 mm to 10 mm.

At each of the base points Pbn, there exists a normal Nn to the base surface Sb.

According to the invention, a corrected point Pcn is determined starting from each base point Pbn, with the corrected point being situated on the normal Nn so that the distance Dn between Pbn and Pcn along the normal is random or pseudo-random.

In the present preferred example, the value of said distance Dn may be positive or negative, a positive distance corresponding to the point Pcn being situated in front of the base surface (upwards in FIG. 1), and a negative distance corresponding to the point Pcn being situated behind the base surface (downwards in FIG. 1).

Also preferably, the distribution of the distances Di from one point to another is Gaussian, being centered on the value zero and having a standard deviation that is a function of the pitch P of the points Pbn and that preferably lies in the range 25 μm to 750 μm, and more preferably in the range 100 μm to 500 μm.

Once all the corrected points Pcn have been determined, a corrected surface Sc is determined that has the property of passing through all of the corrected points Pcn while being continuously and preferably differentiable.

Various conventional mathematical techniques exist for obtaining a surface Sc satisfying the above criteria and on the basis of the set of three-dimensional coordinates of the points Pcn, in particular their Cartesian coordinates. In particular, it is possible to use the mathematical smoothing techniques of Nurbs or of Bezier, or else polynomial interpolation.

Advantageously, the above steps are performed automatically, at least in part, using conventional computer-aided design equipment. These steps serve to obtain in a form that is technically usable either a set of coordinates of points that are distributed at least as finely as the points Pcn, or else one or more equations that satisfy the above criteria.

The data and/or equations are then used, e.g. for numerically-controlled machining of a mold for use in manufacturing reflectors having a reflecting surface that complies with the surface Sc as defined. Here again, the tools used are conventional in themselves.

Figure 2:
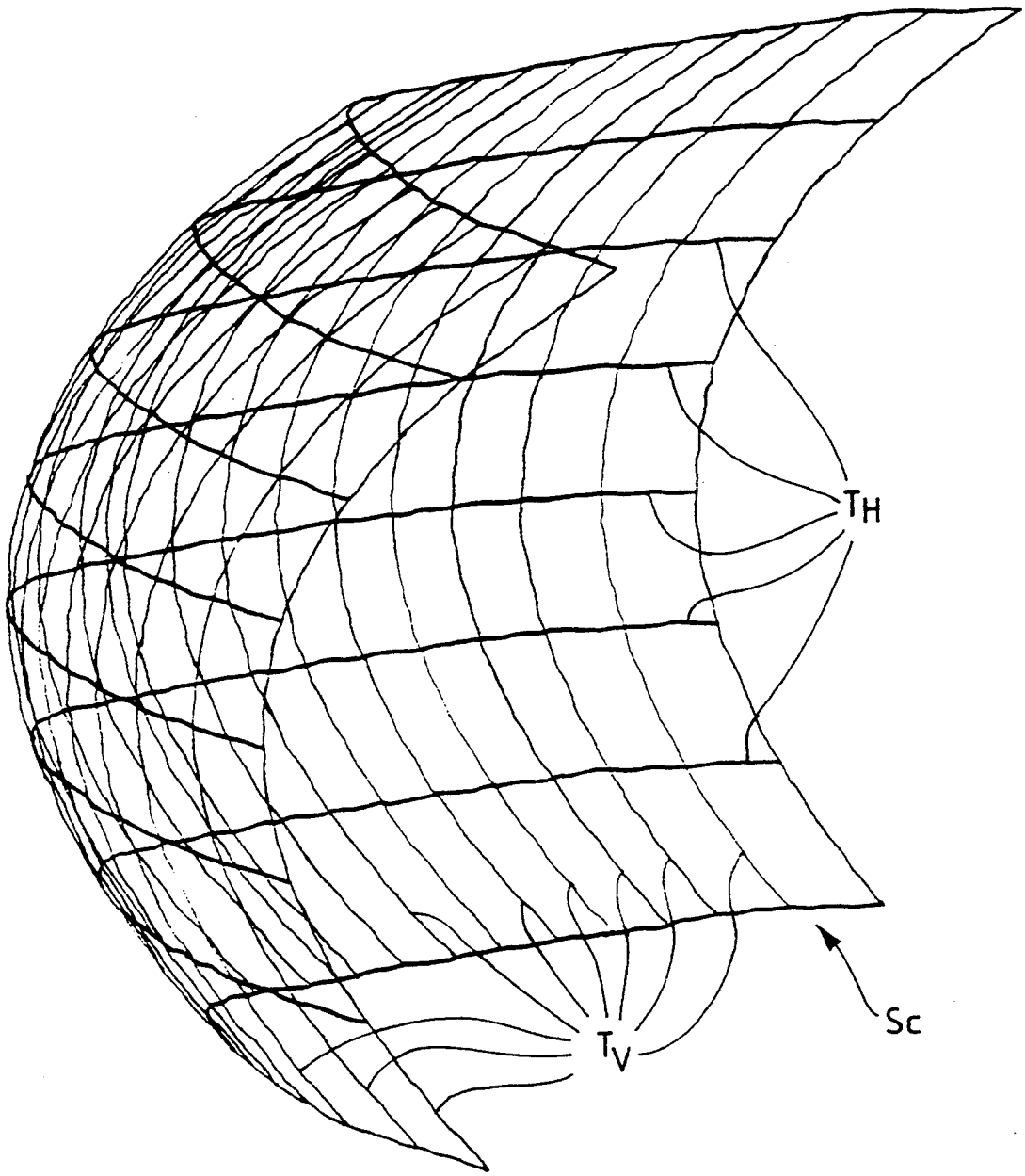
FIG. 2 is an overall view of a reflecting surface made in accordance with the invention, the surface being represented by the traces of its horizontal and vertical sections.

FIG. 2 shows a reflecting surface obtained by the method of the invention, with the surface being represented by its traces $T_H$ and $T_V$ in horizontal and vertical planes respectively. The figure shows the random type undulations present in the surface.

FIGS. 3 and 4 help in understanding the result obtained by a mirror as defined in accordance with the present invention.

FIG. 3 shows filament images on a standard projection screen placed in front of a signalling or lighting device, and in particular it shows four images I1–I4 as produced by a set of points (in this case four points) that are spaced apart by a few millimeters, for example, said points being situated in the region of the back of a conventional type of reflecting surface implemented in accordance with the teaching of Document FR-A-2 609 146, for example, the shape at this location of the mirror is such as to give rise to a large amount of image concentration, and that is undesirable when it is desired to obtain a beam that is uniform.

FIG. 4 shows an example of filament images I1′–I4′ obtained by a mirror treated in accordance with the present invention, as produced by points that correspond to the points used for FIG. 3.

It can be seen that the images are dispersed in various directions and by varying amounts. Since this phenomenon is repeated over all of the regions of the mirror, the final result is a beam that is uniform.

Figure 5:
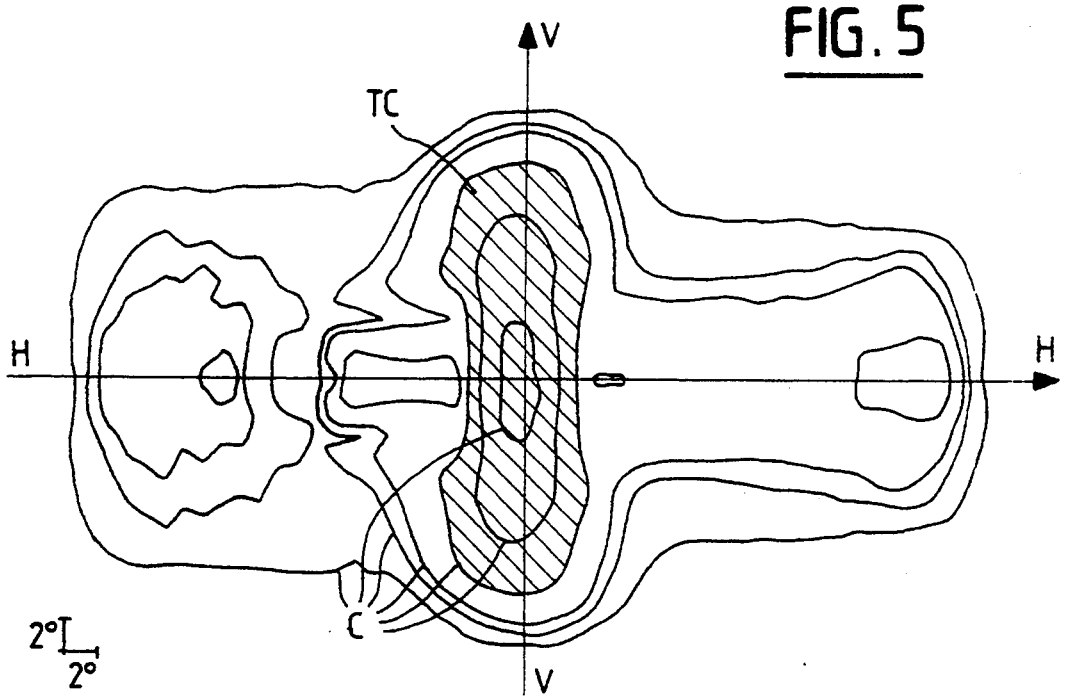
FIG. 5 shows the appearance in the form of a set of isocandela curves on a projection screen of a beam obtained using a bare mirror of the prior art.

FIG. 5 is a set of isocandela curves C showing the configuration of a signalling beam obtained from a mirror made in accordance with the teaching of abovementioned French patent application FR-A-2 609 146. A relatively well-marked concentration spot TC can be seen in the central region of the beam, which spot is very narrow and extends vertically nearly all the way across the beam, which is not desirable.

Figure 6:
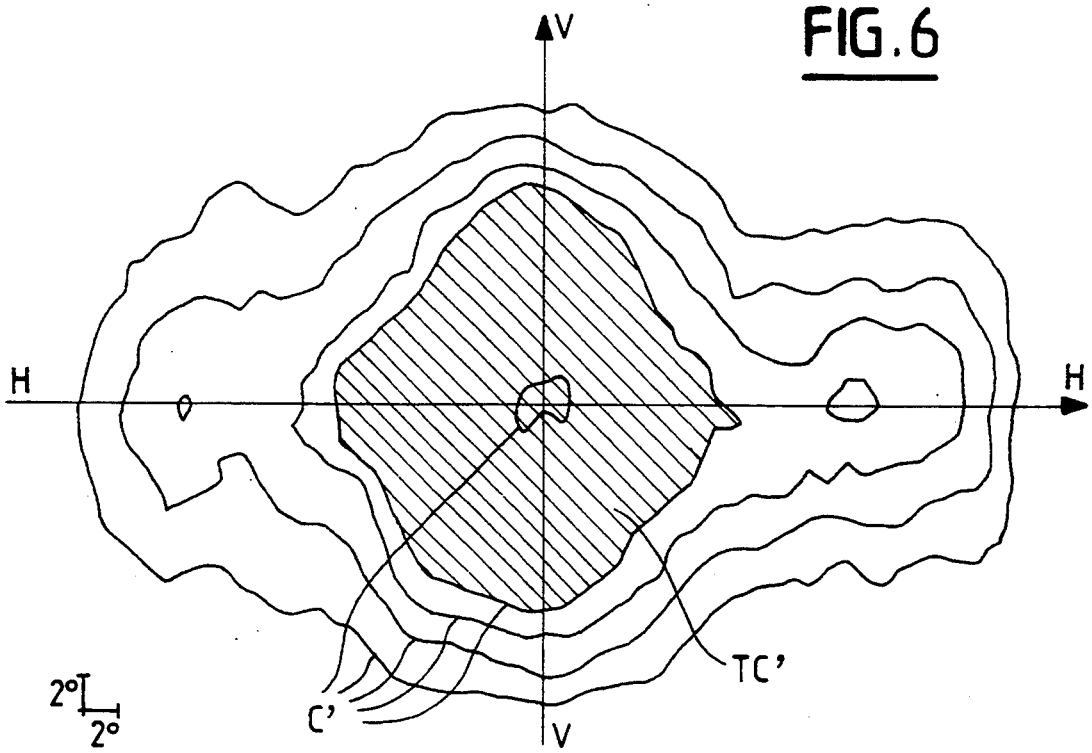
FIG. 6 is similar to FIG. 5 showing the appearance of a beam obtained using a bare mirror of the present invention.

FIG. 6 is similar to FIG. 5 and shows the configuration of the beam that is obtained when the mirror has the same basic design but has been treated in accordance with the present invention. Isocandela curves are marked C′ and the concentration spot is marked TC′.

It may be observed that the concentration spot is diluted laterally and is reduced vertically, with the intensity of the beam being much more uniform, as illustrated in particular by the greater mutual spacing between the isocandela curves.

Naturally, the present invention applies not only to signalling lights that include a mirror (in particular reversing lights, brake lights, rear fog lights, side lights, and indicator lights), but also to headlights.

In addition, the concepts of the present invention can be implemented either over the entire reflecting surface of the mirror or else over a portion only of said surface, and in particular the portion from which the excess concentration in a part of the beam originates.

The present invention is not limited in any way to the embodiment described above and shown in the drawings, and the person skilled in the art will be able to make variations and modifications within the spirit of the invention.

I claim:

1. A method of manufacturing a flux-recovering mirror for a motor vehicle signalling or lighting device, the method comprising the following steps:

defining a base reflecting surface;

distributing mutually spaced apart base points in at least one zone of said surface;

attributing a randomly determined correcting offset to each base point so that each base point is associated with a corrected point situated on the normal to the base surface at said base point and located at a random distance from said base point;

defining in said zone, a corrected smooth surface passing through the corrected points; and making a mirror whose reflecting surface in said zone is constituted by said corrected smooth surface.

2. A method according to claim 1, wherein the base points are equidistant in pairs, at least in one direction.

3. A method according to claim 2, wherein the base points are equidistant in pairs in two directions that are mutually perpendicular.

4. A method according to claim 2, wherein the base points are equidistant in pairs by a distance lying in the range 0.5 mm to 15 mm, and preferably in the range 2 mm to 10 mm.

5. A method according to claim 1, wherein the values of the offsets from one point to another are random.

6. A method according to claim 5, wherein the values of the offset are randomly distributed with a Gaussian distribution.

7. A method according to claim 6, wherein the standard deviation of the offset having a Gaussian distribution lies in the range 25 μm to 750 μm, and preferably in the range 100 μm to 500 μm.

8. A method according to claim 4, wherein the values of the offset are randomly distributed with Gaussian distribution.

9. A method according to claim 8, wherein the standard deviation of the offset having a Gaussian distribution lies in the range 25 μm to 750 μm and preferably in the range 100 μm to 500 μm.

10. A motor vehicle signalling or lighting device of the type comprising a light source, a mirror including a reflecting surface, and a glass, the reflecting surface being designed to generate a uniform beam, wherein for an arbitrary correlated set of points situated in at least one zone of said reflecting surface, images of the source formed by said points are distributed on a projection screen in a manner such that they are not correlated relative to one another.

11. A device according to claim 10, wherein the images of the source are distributed in a manner that is not correlated in two dimensions.

* * * * *